US007611264B1

(12) United States Patent
Chang et al.

(10) Patent No.: US 7,611,264 B1
(45) Date of Patent: Nov. 3, 2009

(54) LED LAMP

(75) Inventors: Kun-Jung Chang, Kaohsiung County (TW); Ching-Yuan Juan, Kaohsiung County (TW); Kuo-Chun Lin, Kaohsiung County (TW); Ching-Huang Juan, Kaohsiung County (TW)

(73) Assignee: Li-Hong Technological Co., Ltd., Kaohsiung County (TW)

( * ) Notice: Subject to any disclaimer, the term of this patent is extended or adjusted under 35 U.S.C. 154(b) by 0 days.

(21) Appl. No.: 12/200,267

(22) Filed: Aug. 28, 2008

(51) Int. Cl.
*F21S 4/00* (2006.01)

(52) U.S. Cl. ..... 362/249.02; 362/294; 362/373

(58) Field of Classification Search ..... 362/227, 362/236, 240, 244, 245, 249.02, 249.012, 362/294, 308, 310, 326, 327, 335, 336, 373, 362/404, 405, 410, 543–549, 800, 806
See application file for complete search history.

(56) References Cited

U.S. PATENT DOCUMENTS

2007/0076413 A1* 4/2007 Mingozzi ..... 362/249
2008/0084701 A1* 4/2008 Van De Ven et al. ..... 362/373
2008/0151052 A1* 6/2008 Erel et al. ..... 348/143

* cited by examiner

*Primary Examiner*—Hargobind S Sawhney
(74) *Attorney, Agent, or Firm*—Muncy, Geissler, Olds & Lowe, PLLC

(57) ABSTRACT

A LED lamp includes a main body surrounded by a fin assembly on the periphery at an upper side and a lower side, a power supply holder located at the upper side and a plurality of LED lamp assemblies located at the lower side. The LED lamp assemblies are encased by a light converging plate which is further encased by a transparent lamp shade fastening to the lower side of the main body. The LED lamp thus formed may be fastened to a ceiling for indoor use through an upper cap of a fastening assembly, or an outdoor electric wire pole through a fastening tray. Each of the LED lamp assemblies has a heat transfer tube to transfer the generated heat to the main body for dispersing through the fin assembly. Thus desired heat dissipation can be accomplished.

12 Claims, 12 Drawing Sheets

LED LAMP

FIELD OF THE INVENTION

The present invention relates to a LED lamp and particularly to a LED lamp adopted for use indoors or outdoors that has a main body and a fin assembly surrounding the main body to efficiently and quickly disperse heat generated by the LED lamp.

BACKGROUND OF THE INVENTION

The conventional LED lamps now on the market can generate light with a small amount of electric power, but also generate heat at the same time. To make replacement of the LED lamp easier a protective case is usually provided in the center thereof for user holding. The protective case traps the generated heat inside and results in undesirable heat dissipation. Hence the LED lamp is prone to damaging and results in a lower durability. To remedy the aforesaid problem some producers develop a technique by attaching the LED lamp to a lower side of a heat transfer plate and providing spaced radiation fins above the heat transfer plate. However, the power supply holder above the LED lamp does not have cooling means, a great amount of heat is generated during use. Although the heat transfer plate can receive the heat generated by the LED lamp and transfer to the radiation fins for dispersion, the heated radiation fins reciprocate the heat one another to make contact heat transfer function saturated and result in a higher temperature on the whole lighting feature. Cooling becomes even more difficult, especially on the power supply holder. Hence the life span of the LED lamp suffers. How to improve heat dissipation of the LED lamp is an issue remained to be overcome in the industry.

SUMMARY OF THE INVENTION

The primary object of the present invention is to solve the aforesaid problems of the conventional LED lamp that generates higher temperature on the power supply holder at the upper side of the LED lamp and is difficult to disperse heat during lighting. The invention provides a LED lamp for indoor and outdoor use that has a main body and a fin assembly surrounding the main body to efficiently disperse heat generated during lighting.

To achieve the foregoing object, the invention provides features as follow:

A LED lamp includes a main body, a fastening assembly, a plurality of LED lamp assemblies, a light converging plate and a transparent lamp shade. The main body has the periphery surrounded by a fin assembly at the upper side and the lower side and a power supply holder at an upper side. The LED lamp assemblies are located below the main body. The power supply holder has a plurality of vents to hold power supplies equipped with ballasts. The main body is fastened to an indoor ceiling through the fastening assembly. The light converging plate is installed on a lower side of the LED lamp assemblies, then they are encased by the transparent lamp shade by screwing. Heat generated by the LED lamp assemblies is transferred to a heat transfer tube at an upper side and the main body to be dispersed through the fin assembly. Thus a desired cooling effect can be accomplished. When the LED lamp is used outdoors, a fastening tray is provided in the fastening assembly to fasten the main body to an electric wire pole.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
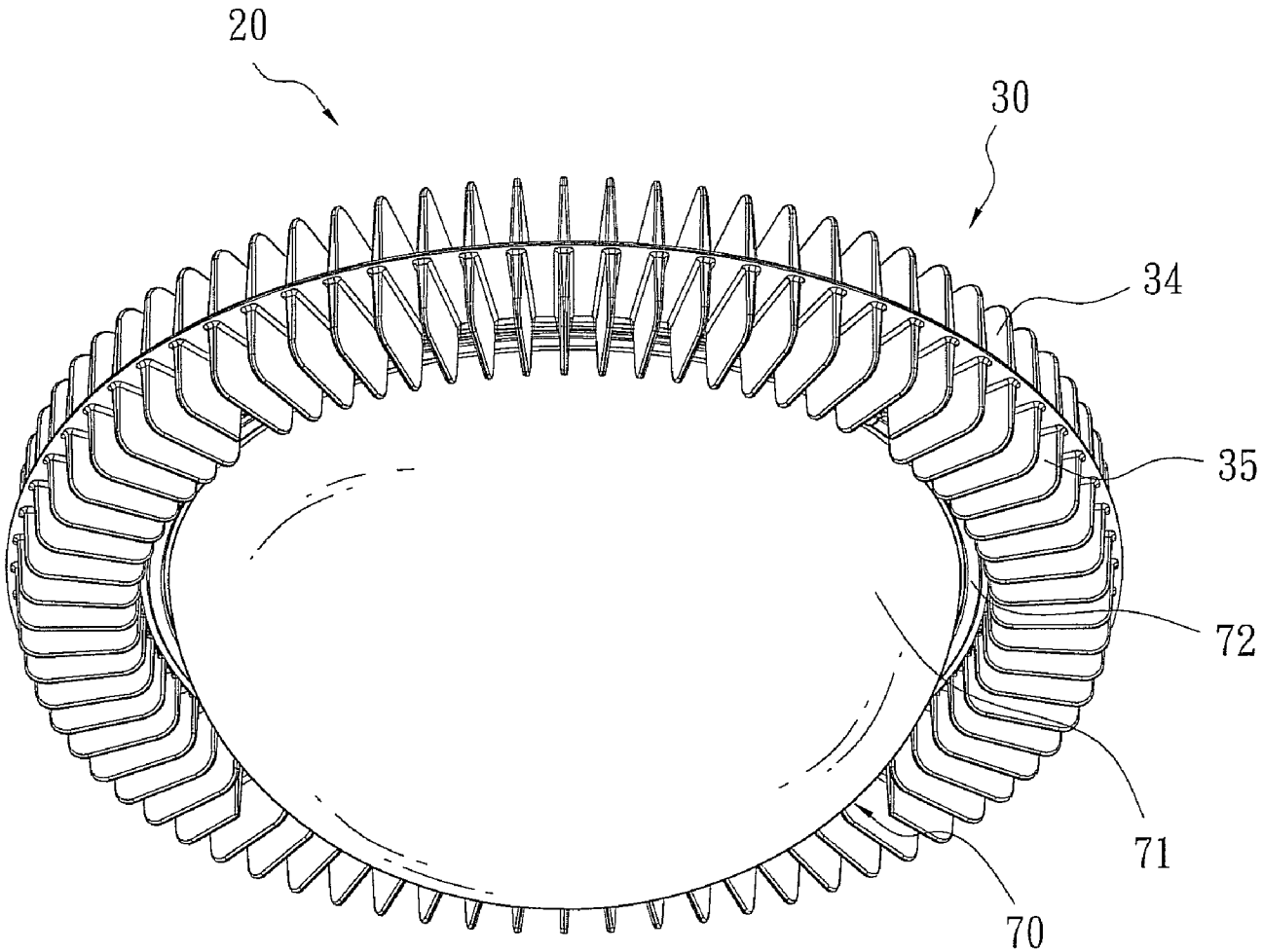
FIG. 1 is a perspective view of the invention viewed from a lower side.
Figure 2:
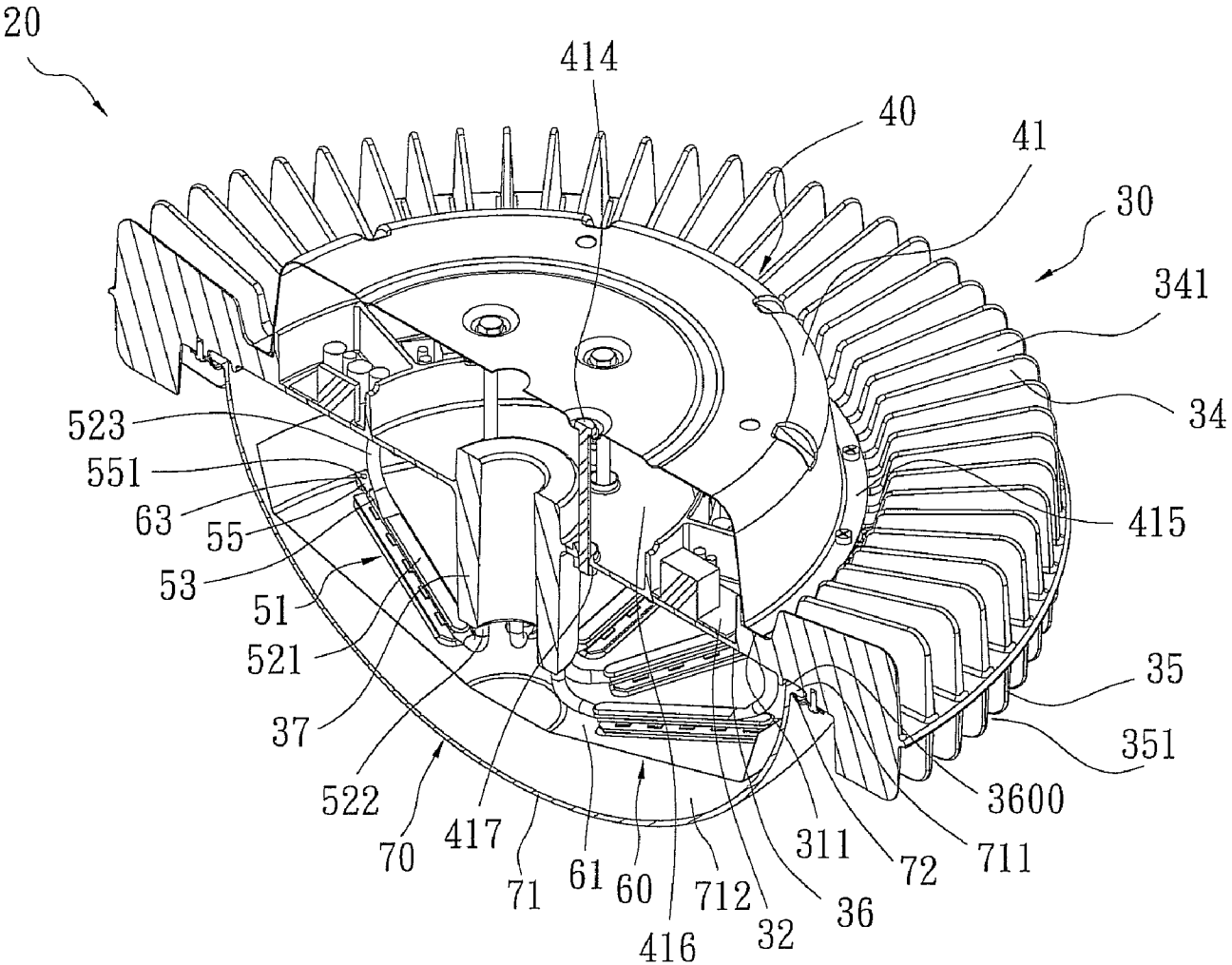
FIG. 2 is a perspective view of the invention, partly cutaway.
Figure 3:
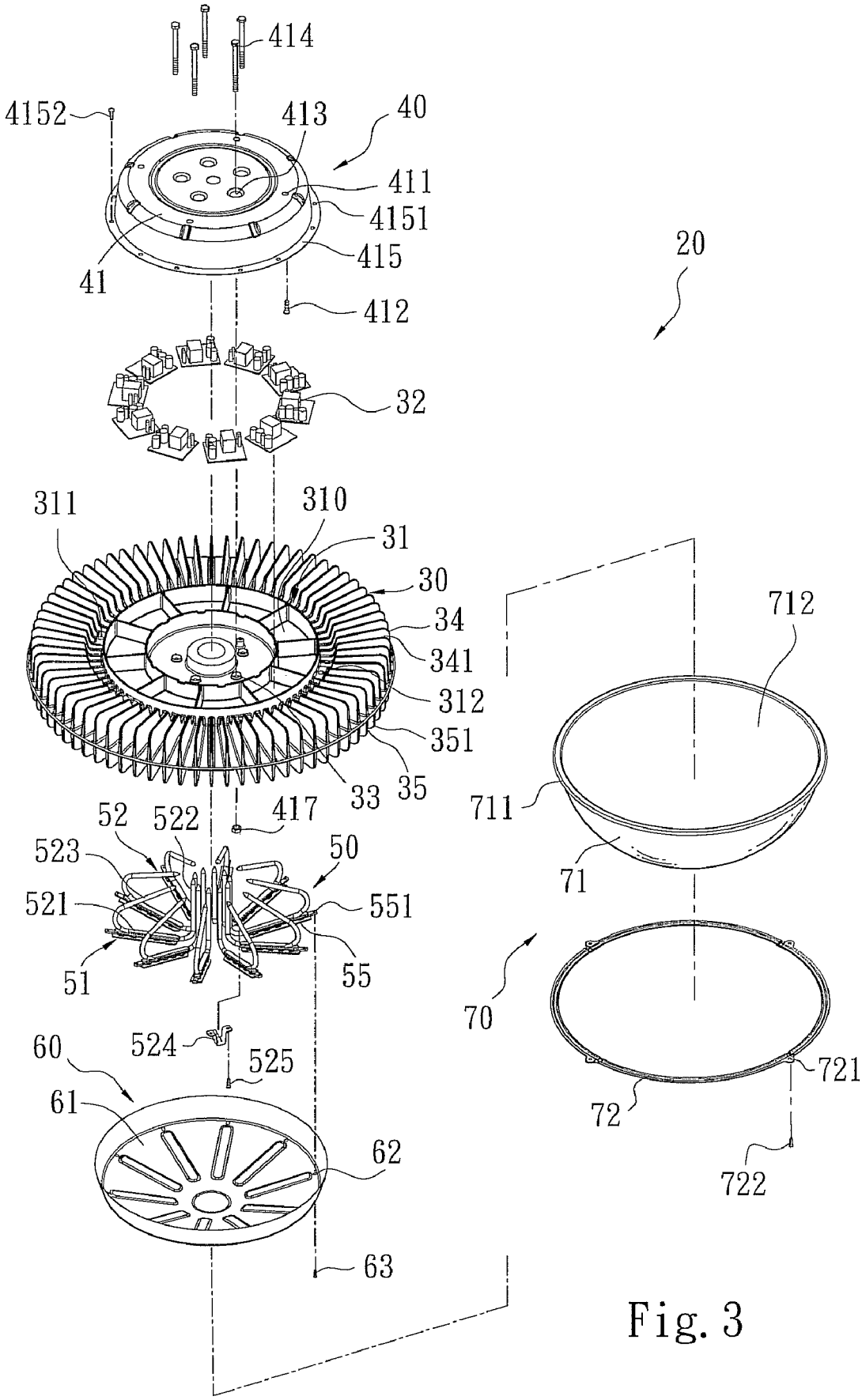
FIG. 3 is an exploded view of the invention adopted for use indoors.

Please referring to FIGS. 1 through 5B, the LED lamp 20 according to the invention includes at least a main body 30, a fastening assembly 40, a plurality of LED lamp assemblies 50, a light converging plate 60 and a transparent lamp shade 70.

Figure 4:
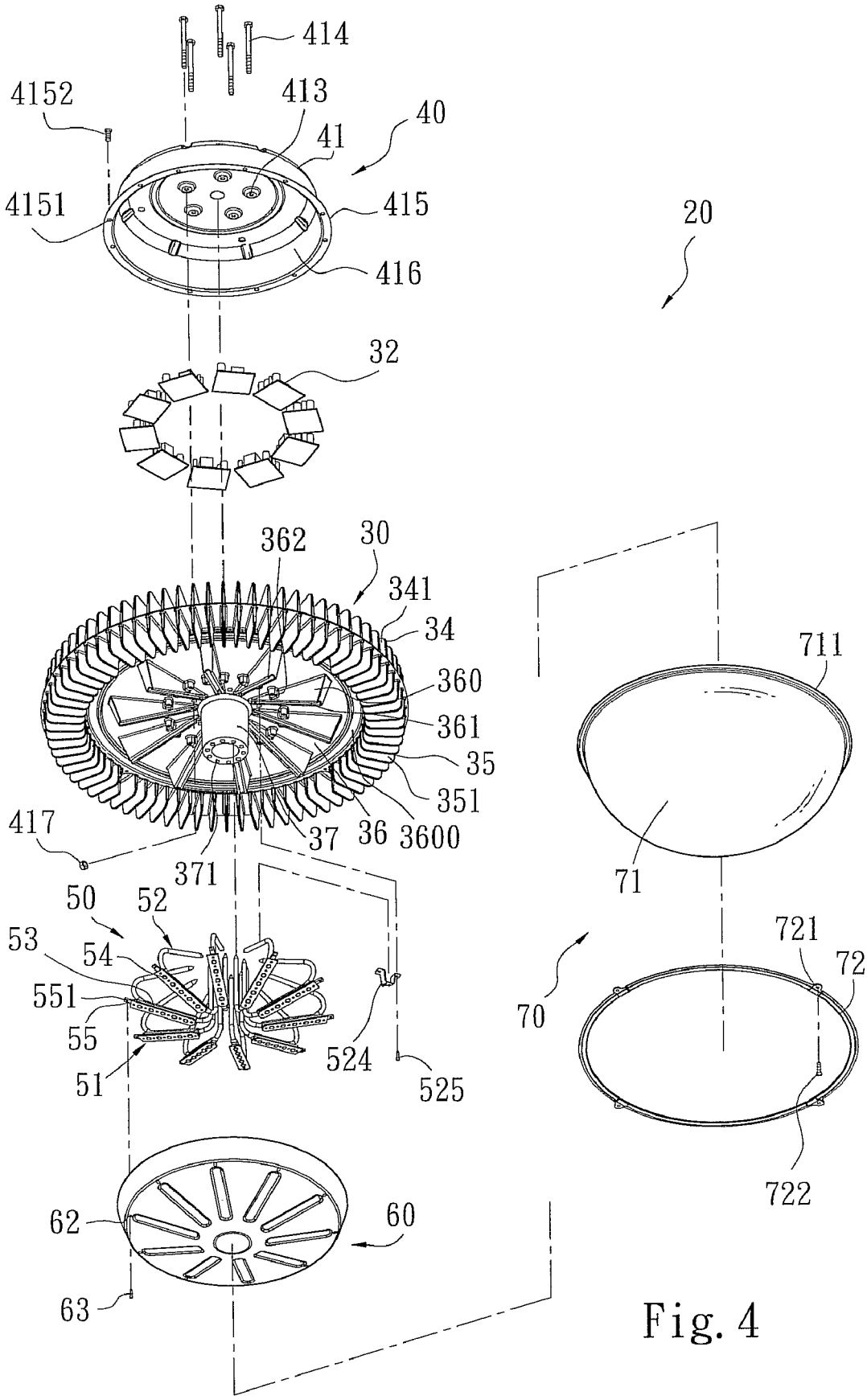
FIG. 4 is an exploded view according to FIG. 3 viewed from a lower side.

The main body 30 has a power supply holder 31 at an upper side. The power supply holder 31 has a plurality of vents 310 and a rim coupler 311 which has a plurality of fastening holes 312 to be fastened by the fastening assembly 40. The vents 310 aim to hold a plurality of power supplies 32 equipped with ballasts for the LED lamp assemblies 50. The main body 30 has a plurality of apertures 33 around the center thereof at the upper side for fastening with the fastening assembly 40. The main body 30 has the periphery coupled with fin assemblies 34 and 35 at an upper side and a lower side. The fin assemblies 34 and 35 may be formed and configured to match the profile of the main body 30 or lamp casing, and consist of fins spaced from one another at intervals 341 and 351 to disperse heat. The lower fin assembly 35 has a recess 36 and an annular groove 3600 around the recess 36 to be coupled with the transparent shade 70. The recess 36 holds a plurality of lamp seats 360 and a jutting coupler 37 in the center that has a plurality of holes 371 formed thereon. Referring to FIG. 4, in an embodiment of the invention the lamp seats 360 are arranged in radial fashion or in a selected manner according to the profile of the main body 30 or lamp casing. In FIG. 4 each lamp seat 360 is angular and inclined and shrink gradually from an outer side towards an inner side, and has one end with a trough 361 formed thereon and two sides each has a fastening hole 362 to anchor one LED lamp set 51 of the LED lamp assemblies 50.

Figure 6:
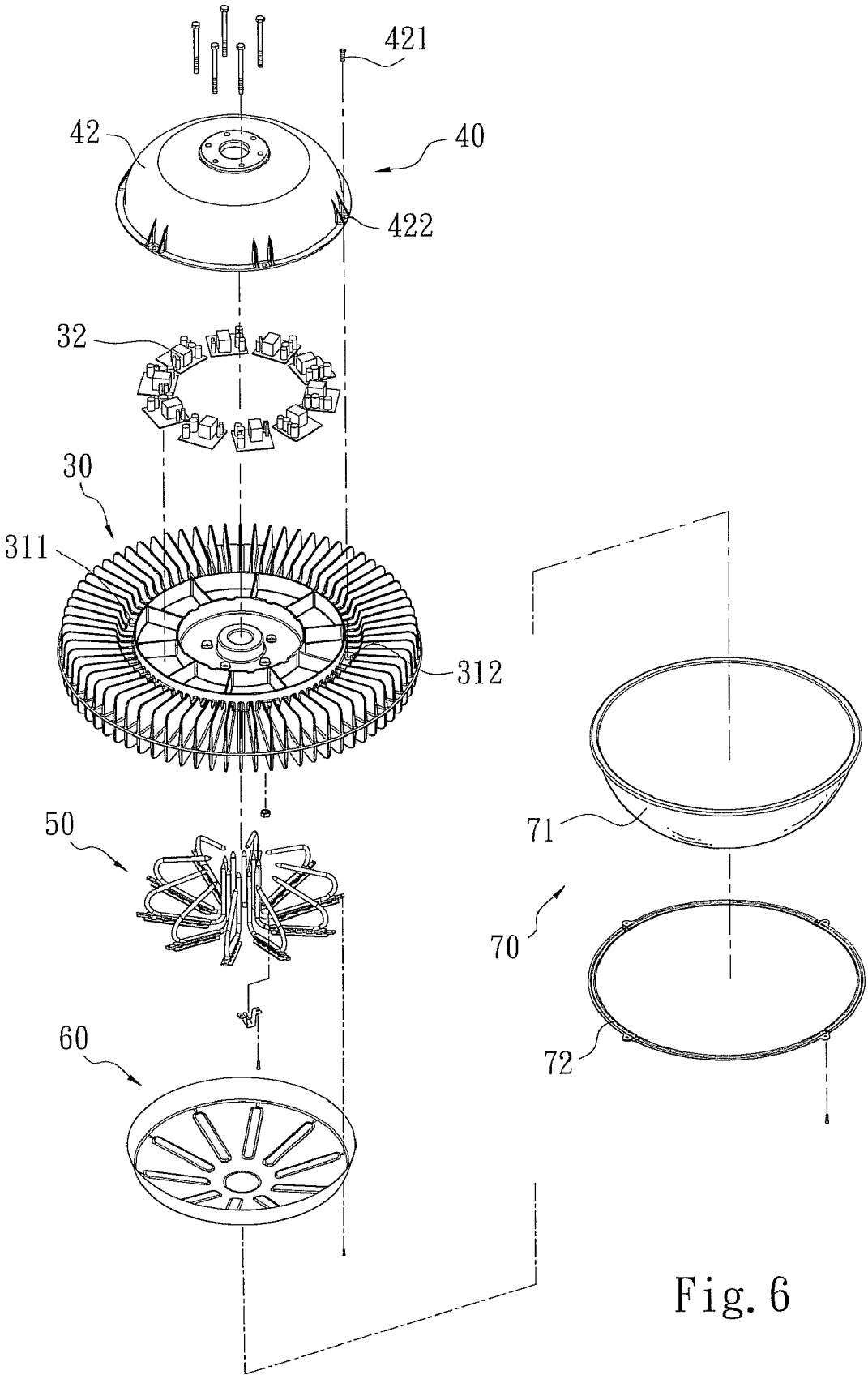
FIG. 6 is an exploded view of the LED lamp of the invention adopted for use outdoors.

The fastening assembly 40 has an upper cap 41 for indoor use. The upper cap 41 has a plurality of apertures 411 on an outer rim of an upper side thereof to be fastened to a ceiling through fastening elements 412, and a plurality of sunken holes 413 on an inner rim to receive bolts 414 to fasten the upper cap 41 and the main body 30 together by coupling with fastening elements 417 such as nuts. The upper cap 41 further has a flange 415 extended outwards from a lower end to be fastened to the rim coupler 311 of the main body 30. It also has a housing chamber 416 inside to encase the power supplies 32 so that the entire lamp can be fastened to the indoor ceiling. In the event that the LED lamp 20 is to be installed outdoors, referring to FIG. 6, the fastening assembly 40 is formed in a fastening tray 42 with the perimeter run through by a plurality of fastening elements 421 to screw the main body 30 on an electric wire pole (not shown in the drawings). Such a structure can increase the structural strength and also provide watertight effect.

Each LED lamp set 51 of the LED lamp assemblies 50 includes a heat transfer tube 52 equipped with a diagonal blade 521 on an outer side, a heat transfer member 53, a LED lamp 54 and a base plate 55. The heat transfer tube 52 may be solid or hollow, and has one end formed a protrusive strut 522 to run through the hole 371 of the jutting coupler 37 of the main body 30 to form electric connection with the power supplies 32, and another end bent to form the diagonal blade 521 extended outwards and coated with silver for reflection to converge light. The diagonal blade 521 has the bottom fastened to each LED lamp set 51 and a diagonal stem 523 bent to be wedged in the trough 361 of the lamp seat 360 (referring to FIG. 5B). Then a clipping reed 524 and a screw 525 are provided to engage with the fastening hole 362 to fasten to the lamp seat 360. The heat transfer member 53 is attached to the bottom of the diagonal blade 521. The LED lamp 54 has a polar plate at one side and a LED at another side surround by a protective frame. The base plate 55 is a printed circuit board with circuits and openings formed thereon to be wedged in by the LED lamp 54 that is connected in series to enhance brightness. The base plate 55 also has apertures to receive fastening elements to fasten to the heat transfer member 53. The heat transfer member 53 is a metal slat with a high thermal conductivity and formed at a desired thickness to function as a heat transfer medium. It is bonded to the polar plate of the LED lamp 54 to disperse heat when the LED lamp 54 is energized. The heat transfer member 53 has a plurality of fastening holes to be coupled with the base plate 55 through fastening elements.

The light converging plate 60 has a housing chamber 61 to hold the LED lamp assemblies 50 at the lower side of the main body 30. It has a plurality of apertures 62 at the bottom close to the perimeter thereof corresponding to fastening holes 551 on an outer side of the base plate 55 to receive fastening elements 63 for fastening to each LED lamp set 51. The light converging plate 60 can prevent light beams emitted from the LED lamp 54 from reflecting from the transparent lamp shade 70 to the main body 30 to incur loss.

The transparent lamp shade 70 includes a transparent shade 71 and a shade anchor ring 72. The transparent shade 71 has a flange 711 at an upper end to wedge in the annular groove 3600 at the lower side of the main body 30 and a concave chamber 712 to protect the LED lamp 54 and the internal structure so that the light emitted from the LED lamp 54 can transmit outward with minimum loss. The shade anchor ring 72 has a plurality of fastening lugs 721 at the perimeter to fasten the transparent shade 71 to the lower side of the main body 30 through bolts 722.

Figure 5A:
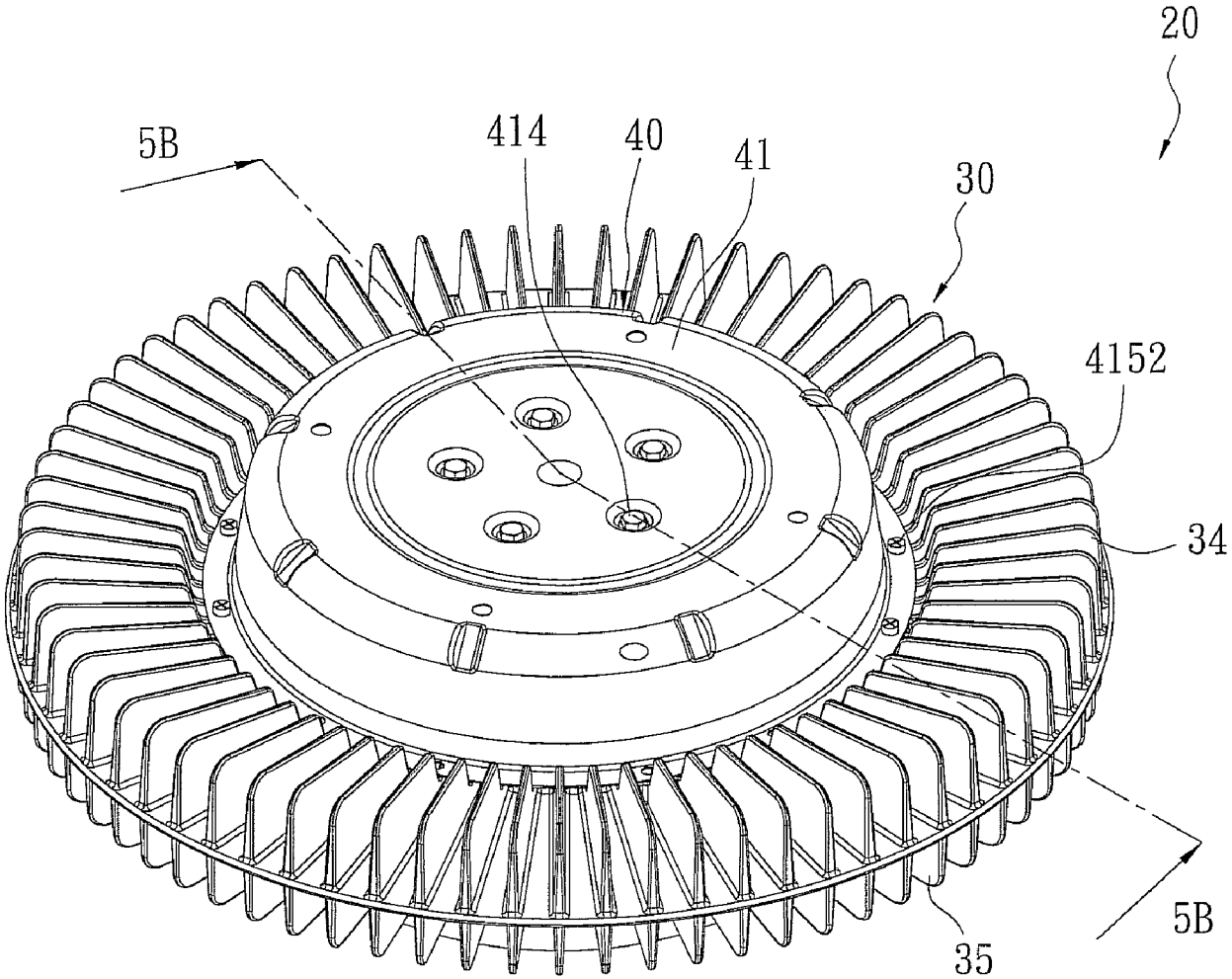
FIG. 5A is a perspective view of the invention.
Figure 5B:
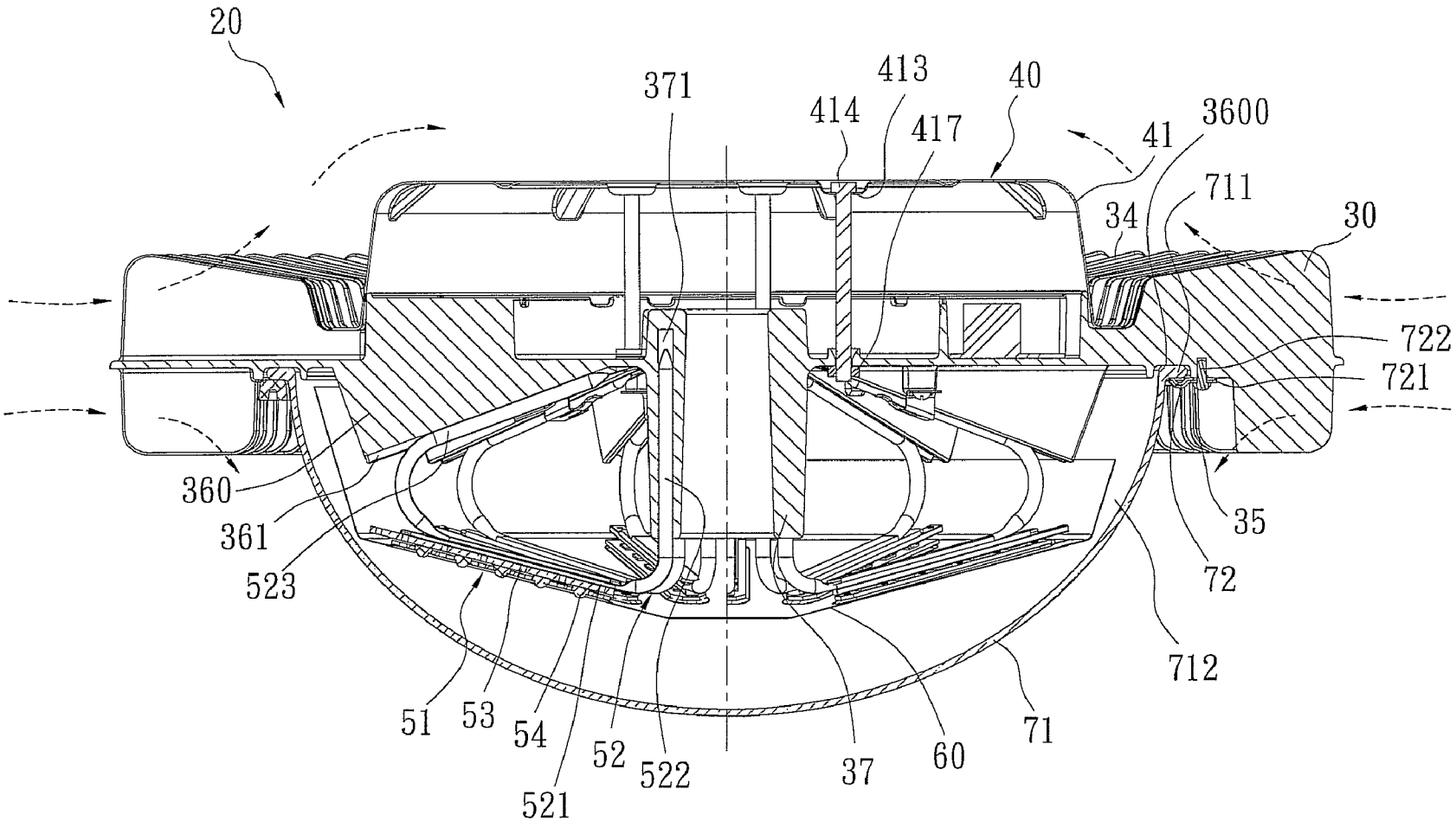
FIG. 5B is a cross section taken on line 5B-5B in FIG. 5A.

Referring to FIGS. 5A and 5B, for assembly of the invention, dispose the power supplies 32 equipped with ballasts for the LED lamp sets 51 on the plurality of vents 310 of the power supply holder 31; depending on use indoors or outdoors, the upper cap 41 or fastening tray 42 may be chosen for the fastening assembly 40 (also referring to FIG. 6); install the LED lamp set 51 on the lower side of the main body 30, and fasten the heat transfer tube 52 of each LEF lamp set 51 with the clipping reed 524 and fasten the base plate 55 and the light converging plate 60; finally encase the light converging plate 60 with the transparent shade 71 and fasten the shade anchor ring 72 by screwing to finish the assembly. When in use, the LED lamp set 51 at the bottom of the diagonal blade 521 at another end of the heat transfer tube 52 is energized and generates heat. Referring to FIG. 5B, the heat is transferred from the heat transfer tube 52 to the fin assemblies 34 and 35 for dispersing. Thus heat generated by the LED lamps 54 in the LED lamp assemblies 50 at the lower side of the main body 30 can be dispersed quickly.

Figure 7:
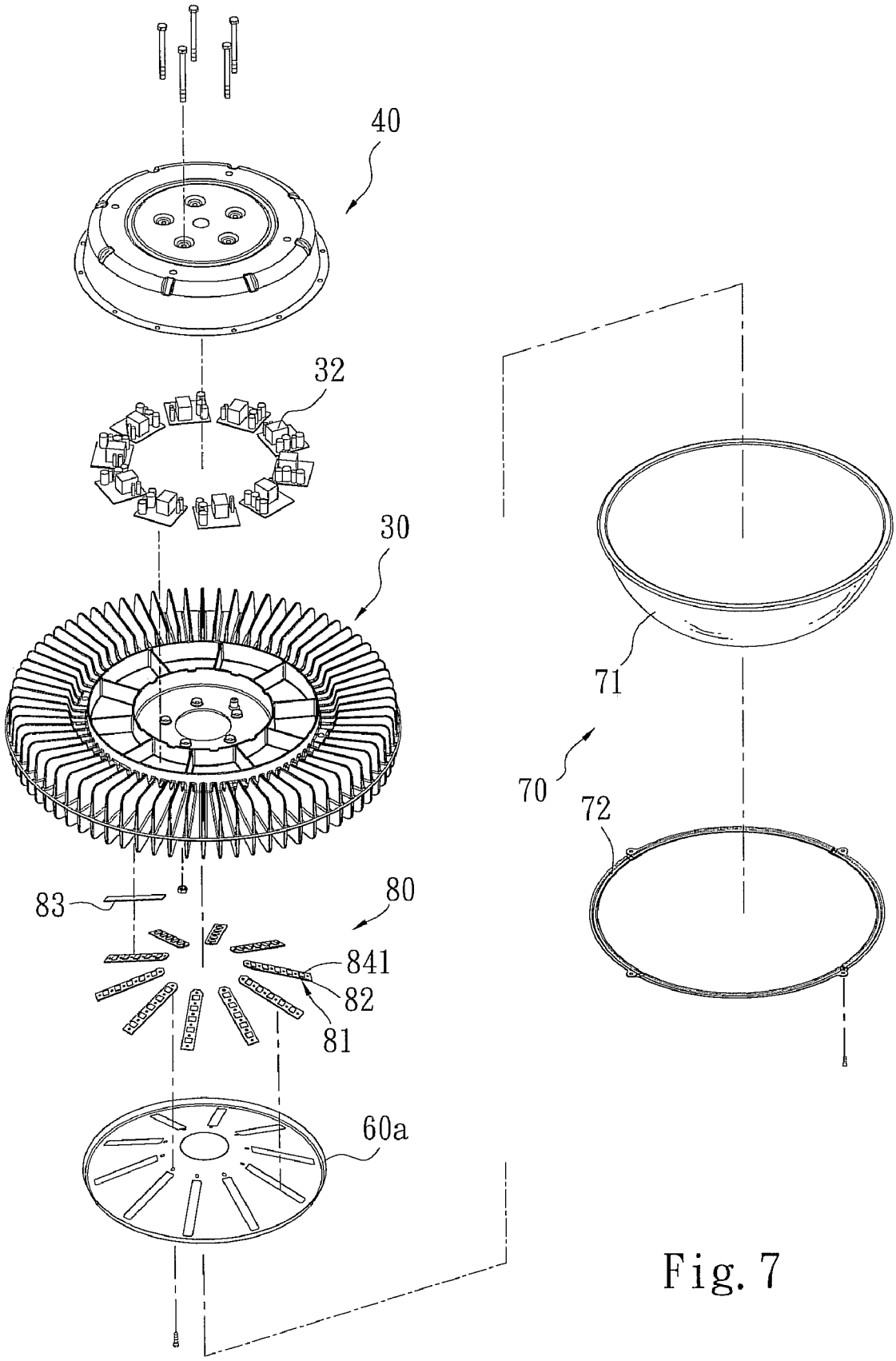
FIG. 7 is an exploded view of another embodiment of the main body and LED lamp assembly adopted for use indoors.
Figure 8:
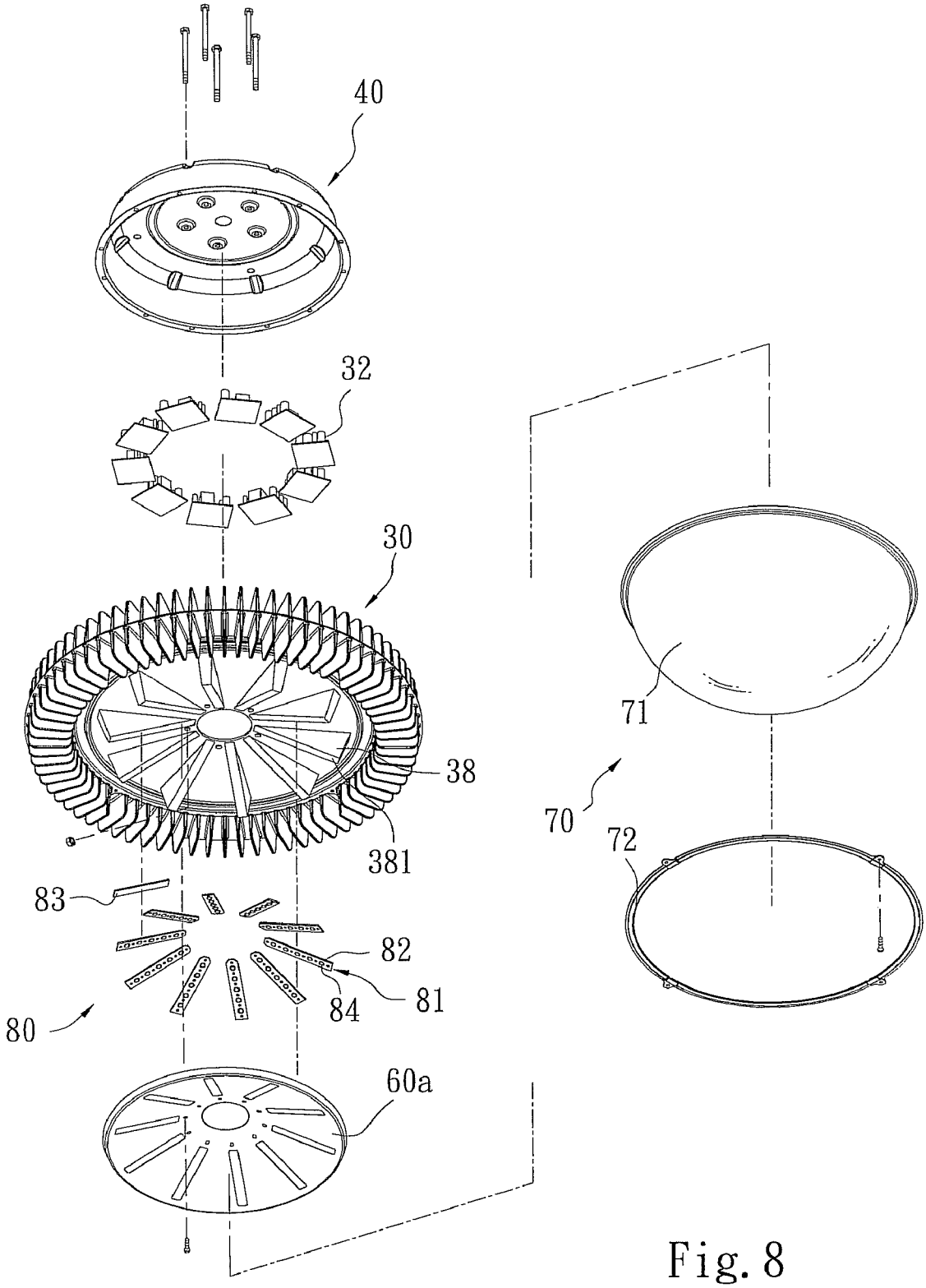
FIG. 8 is an exploded view according to FIG. 7 viewed from a lower side.
Figure 9A:
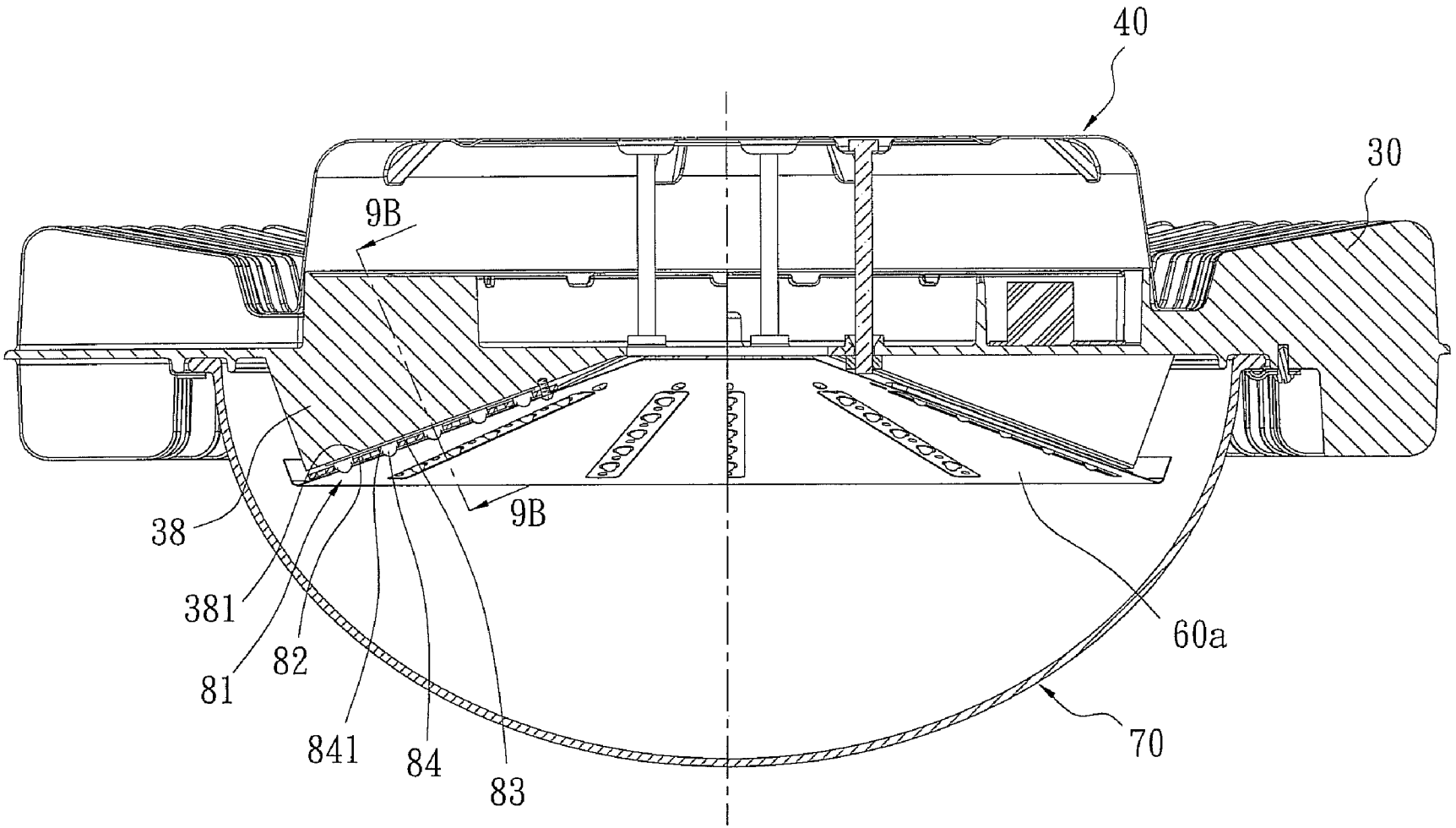
FIG. 9A is a sectional view according to FIG. 7 in an assembled condition.
Figure 9B:
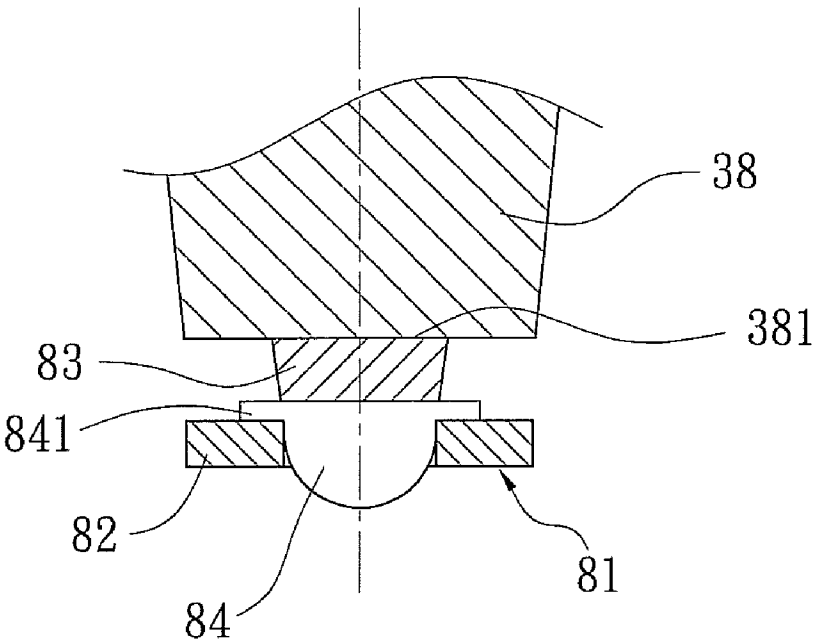
FIG. 9B is a cross section taken on line 9B-9B in FIG. 9A.

Refer to FIGS. 7, 8 and 9A for another embodiment of the main body 30 and LED lamp assemblies 50. It is substantially structured like the one shown in FIGS. 3 and 4. The only difference is that each of the LED lamp assemblies 80 has a LED lamp set 81 which includes at least a base plate 82 screwing to a light converging plate 60*a*. The base plate 82 has one end surface attached to a heat transfer member 83 made of metal and formed in a desired geometric elongated shape to serve as the heat transfer medium to be bonded to one side of a polar plate 841 of a LED lamp 84 (referring to FIG. 9B). A plurality of the heat transfer members 83 are directly attached to angular lamp seats 38 located at the lower side of the main body 30 in a radial fashion and inclined upwards gradually from outside bottom towards inside. Thus heat generated by the energized LED lamps 84 can be transferred to the heat transfer members 83 for dispersing. As there is no direct contact between the lamp seat 38 and the base plate 82, the risk of burned down is reduced.

Figure 10:
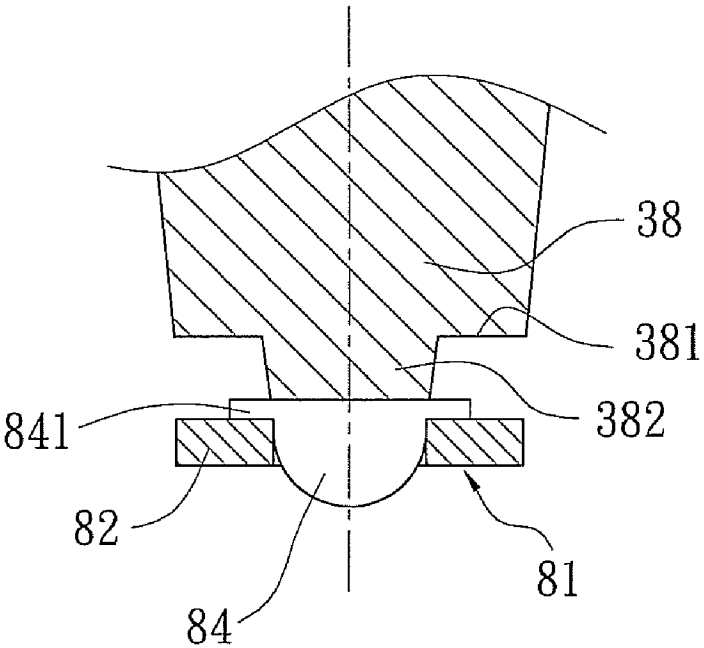
FIG. 10 is a cross section of another embodiment of the lamp seat according to FIG. 7.

Refer to FIG. 10 for another embodiment of the lamp seat 38. It has a flat bonding portion 381 and a heat transfer member 382 extended integrally therefrom to bond one side of the polar plate 841 of the LED lamp 84. The lamp seat 38 also is not directly in contact with the base plate 82, hence the risk of burned down is reduced. Heat generated by the energized LED lamp 84 also can be dispersed through the heat transfer member 382.

Figure 11:
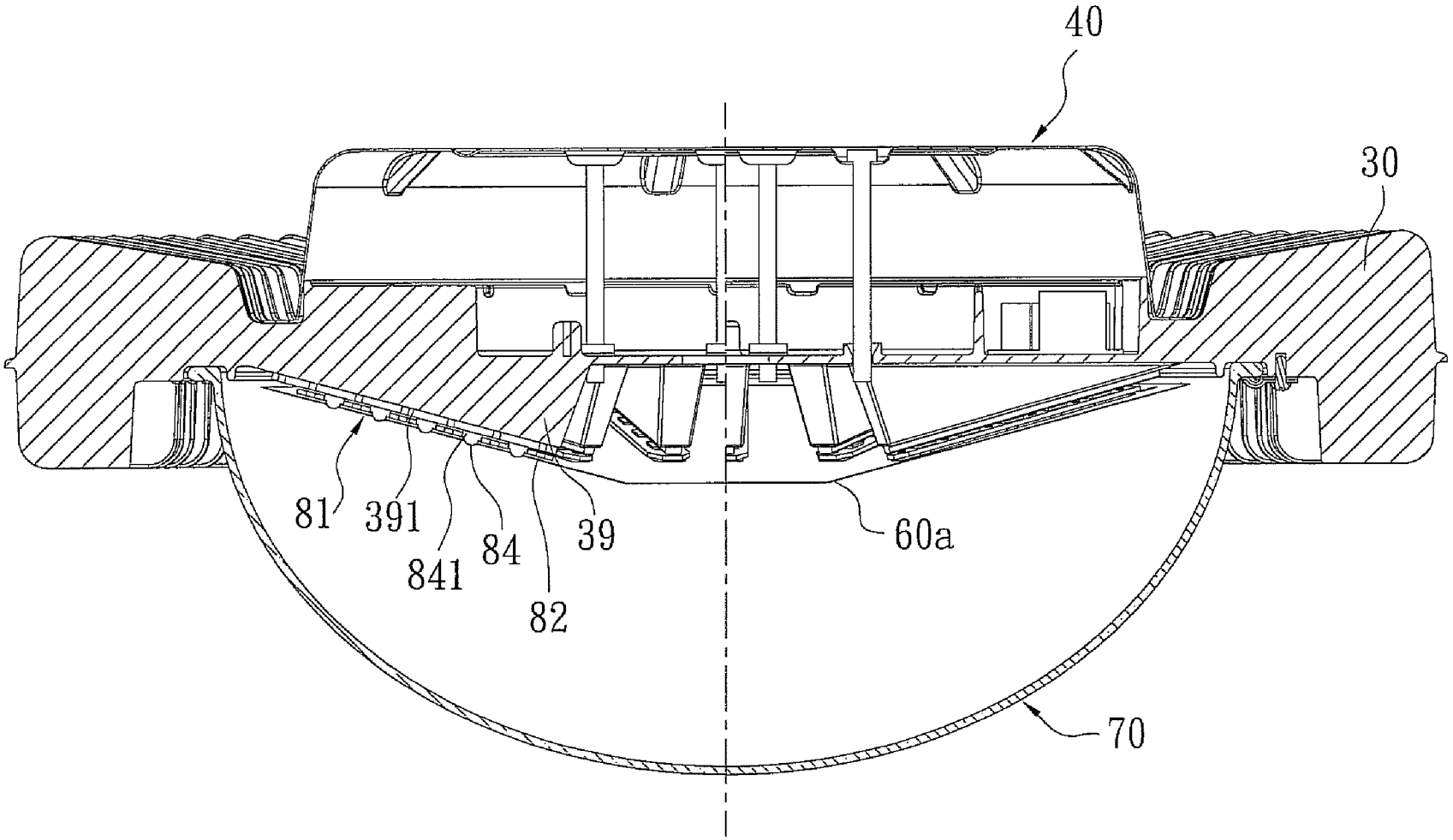
FIG. 11 is a cross section of yet another embodiment of the lamp seat according to FIG. 7 in an assembled condition.

Refer to FIG. 11 for yet another embodiment of the lamp seat 39 based on the lamp seat 38 shown in FIG. 8. It has an angular profile inclined gradually downwards from the top outer side towards inside. A flat bonding portion 391 is formed at one end surface to bond one side of the polar plate 841 of the LED lamp 84 installed on the base plate 82 of each LED lamp set 81. The function of the lamp seat 39 is same as the lamp seat 38 shown in FIGS. 9B and 10. Details are omitted herein.

What is claimed is:

1. An LED lamp, comprising:

a main body which is surrounded by fin assemblies on the periphery at an upper side and a lower side and has a power supply holder at the upper side to hold a power supply equipped with a ballast and a plurality of lamp seats at the lower side;

a fastening assembly to fasten the main body indoors or outdoors;

a plurality of LED lamp assemblies each having an LED lamp set coupled on the lamp seats;

a light converging plate having a housing chamber to hold the LED lamp assemblies located at the lower side of the main body; and a transparent lamp shade which has a transparent shade fastened to the lower side of the main body and a shade anchor ring to fasten the transparent shade.

2. The LED lamp of claim 1, wherein the power supply holder has a plurality of vents to hold the power supply and a plurality of fastening holes on an outer rim and a plurality of apertures on an inner rim to be coupled and fastened to the fastening assembly.

3. The LED lamp of claim 1, wherein the fin assemblies have a recess and an annular groove around the recess to fasten to the transparent lamp shade.

4. The LED lamp of claim 1, wherein the lamp seats are arranged radially.

5. The LED lamp of claim 4, wherein the lamp seats are angular and inclined gradually upwards from an outer bottom end towards an inner side, and have one end surface formed a trough and fastening holes on two sides to fasten to a LED lamp set through a clipping reed and screws.

6. The LED lamp of claim 4, wherein the lamp seats are angular and inclined gradually upwards from an outer bottom end towards an inner side, and have one end surface formed a flat bonding portion to bond one side of a heat transfer member.

7. The LED lamp of claim 4, wherein the lamp seats are angular and inclined gradually downwards from an outer top end towards an inner side, and have one end surface formed a flat bonding portion which is extended integrally to form a heat transfer member.

8. The LED lamp of claim 1, wherein the LED lamp set includes at least a heat transfer tube attached to a diagonal blade inclined outwards, a heat transfer member, a LED lamp and a base plate.

9. The LED lamp of claim 1, wherein the LED lamp set includes a heat transfer member, a LED lamp and a base plate.

10. The LED lamp of claim 1, wherein the fastening assembly includes an upper cap for indoor use, the upper cap having a plurality of apertures on an outer rim of an upper side thereof, a plurality of sunken holes on an inner rim, a flange extended outwards from a lower end to be fastened to the main body, and a housing chamber inside to encase the power supplies equipped with ballasts located at the lower side of the main body.

11. The LED lamp of claim 1, wherein the fastening assembly is a fastening tray for outdoor installation.

12. The LED lamp of claim 1, wherein the transparent shade has a concave chamber and a flange at an upper end, the shade anchor ring having a plurality of fastening lugs at the perimeter engageable with bolts for fastening to the lower side of the main body.

* * * * *